United States Patent [19]

Hermine

[11] 4,231,521

[45] Nov. 4, 1980

[54] WATER SPRINKLER

[75] Inventor: Mair Hermine, Bolzano, Italy

[73] Assignee: Ipierre Sirotex, S.p.A, Italy

[21] Appl. No.: 17,454

[22] Filed: Mar. 5, 1979

[30] Foreign Application Priority Data

Mar. 23, 1978 [IT] Italy ..... 4819 A/78

[51] Int. Cl.[3] ..... B05B 3/14

[52] U.S. Cl. ..... 239/230; 239/228; 239/252; 239/523

[58] Field of Search ..... 239/228, 233, 230, 252, 239/505, 510, 514, 515, 518, 521, 522, 523, 524

[56] References Cited

U.S. PATENT DOCUMENTS

| | | | |
|---|---|---|---|
| 2,963,228 | 12/1960 | Hait | 239/230 |
| 3,785,572 | 1/1974 | Arnold et al. | 239/524 |
| 4,161,286 | 7/1979 | Beamer et al. | 239/230 |

FOREIGN PATENT DOCUMENTS

| | | | |
|---|---|---|---|
| 225020 | 7/1958 | Australia | 239/522 |

*Primary Examiner*—Robert W. Saifer
*Attorney, Agent, or Firm*—Jacobs & Jacobs

[57] ABSTRACT

A water sprinkler comprising a sleeve portion (1, 20, 21) fixedly mountable on a water supply pipe, a rotatable member (2, 22) rotatably mounted on the sleeve, a nozzle device (3, 23) fixedly mounted in the upper portion of the sleeve so as to be coaxial therewith, and a baffle (4, 25) located within the rotatable member, the baffle member being coaxial with the sleeve, the rotatable member having pivotally mounted thereon at least one swing arm (8, 28) carrying at least one shaped member (9, 29) adapted, in use, to lie in the path of water issued from the nozzle and deflected by the baffle.

9 Claims, 6 Drawing Figures

WATER SPRINKLER

WATER SPRINKLER

Figure 1:
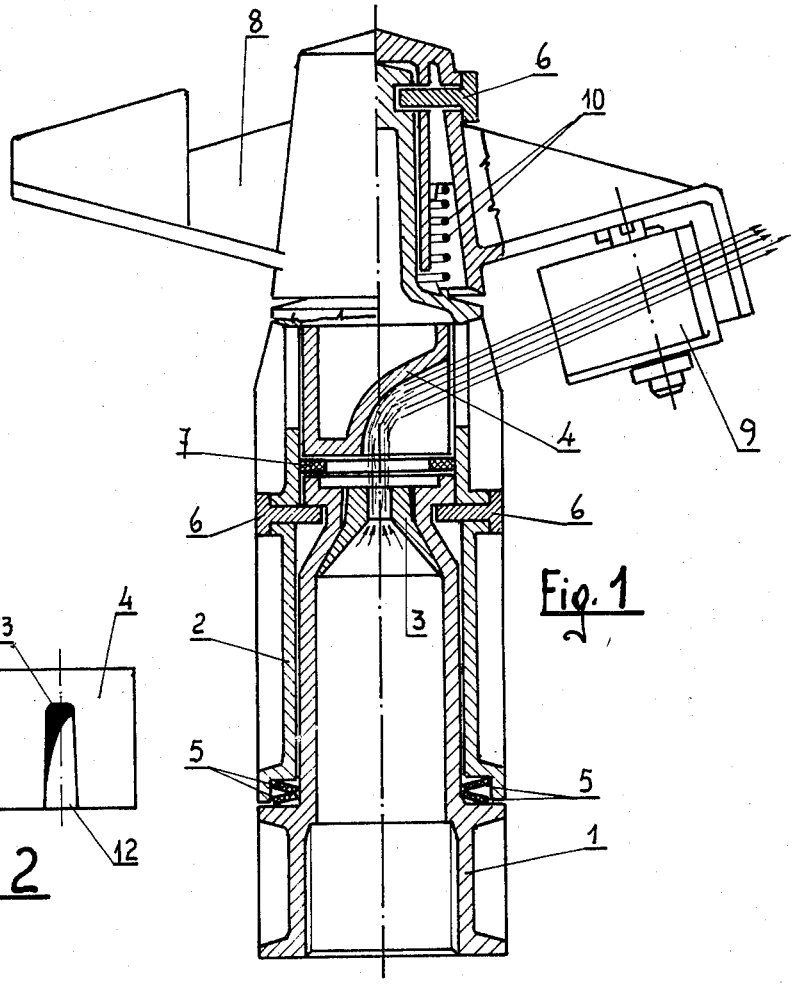

The present invention relates to a water sprinkler.

Known water sprinklers are of two main types. The first of these types usually consists of a body member and a water distribution member. The water is distributed either by centrifugal force or by the water striking downwardly on a small surface area thereby imitating a heavy fall of rain. Such a sprinkler does not normally effect reciprocating movements.

The other, more sophisticated, type of sprinkler comprises a plurality of parts, several of which move. Amongst these moving parts are sealing elements which effect a reciprocating movement. In such a sprinkler, there is generally provided a threaded sleeve which is screwed onto a water delivery pipe. The sleeve houses a rotatable fitting provided with a sealing collar or any other suitable element. At its other end, the rotatable fitting has an elbow jointed member affixed thereto, which member defines one or more nozzles. Such a sprinkler therefore has a fixed member which is the sleeve and rotatable members which are constituted by the rotatable fitting and the elbow member. The rotatable members are caused to rotate by an actuating member affixed to one of the rotating members. This actuating member is acted upon either by the main water flow or by a secondary water flow.

This latter type of sprinkler has the advantage of being capable of watering a large area at a relative low pressure, equivalent to the pressure which would strike the area during a light shower of rain. However, such a sprinkler has certain disadvantages. Thus, the sealing elements which are provided between the fixed and movable parts are easily damaged by particles of grit or sand which are generally present in the water. Secondly, the spray pattern achieved by the nozzles is generally fixed. If it is desired to alter the spray pattern, it is generally necessary to change the elbow member being used for another having a different nozzle arrangement. Thus, for example, for watering under foliage, it is normal to provide one or two jets of water from the sprinkler, each jet issuing from a nozzle at an angle of elevation of between 5° and 7°. To water over foliage in a windy area, the jets should have an angle of elevation of between 15° and 22°. To water a larger area, the jets have an even higher angle of elevation of between 27° and 30°.

Obviously, the costs involved in producing and obtaining such a sprinkler system which can be utilised for all of these purposes is high. Moreover, the number of interchangeable parts required involves storage difficulties.

The present invention therefore seeks to provide a water sprinkler which combines the advantages of these two known types of sprinkler without suffering from their respective drawbacks. Thus, the present invention seeks to provide a sprinkler which is of simple construction and does not require sealing elements but which, nevertheless, is capable of delivering a high output which strikes the ground at low pressure.

According to the present invention, there is provided a water sprinkler comprising a sleeve portion fixedly mountable on a water supply pipe, a rotatable member rotatably mounted on the sleeve, nozzle means fixedly mounted in the upper portion of the sleeve so as to be coaxial therewith, and a baffle located within the rotatable member, the baffle member being coaxial with the sleeve, the rotatable member having pivotally mounted thereon at least one swing arm carrying at least one shaped member adapted, in use, to lie in the path of water issued from the nozzle and deflected by the baffle.

By providing the nozzle on the upper end of the fixed sleeve eliminates the necessity for sealing elements since all of the rotating members are located downstream of the nozzle, and are therefore not dependant on the water supply pressure. Moreover, by locating the baffle in a rotatable member which is coaxial with the sleeve, the baffle may be readily interchanged. By so doing, the water jet may be sub-divided into a plurality of jets and the desired angle of elevation may be given thereto.

Figure 2:
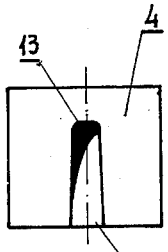
Figure 3:
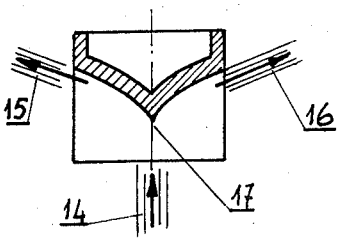
Figure 4:
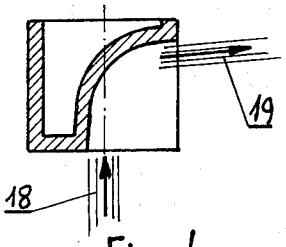
Figure 5:
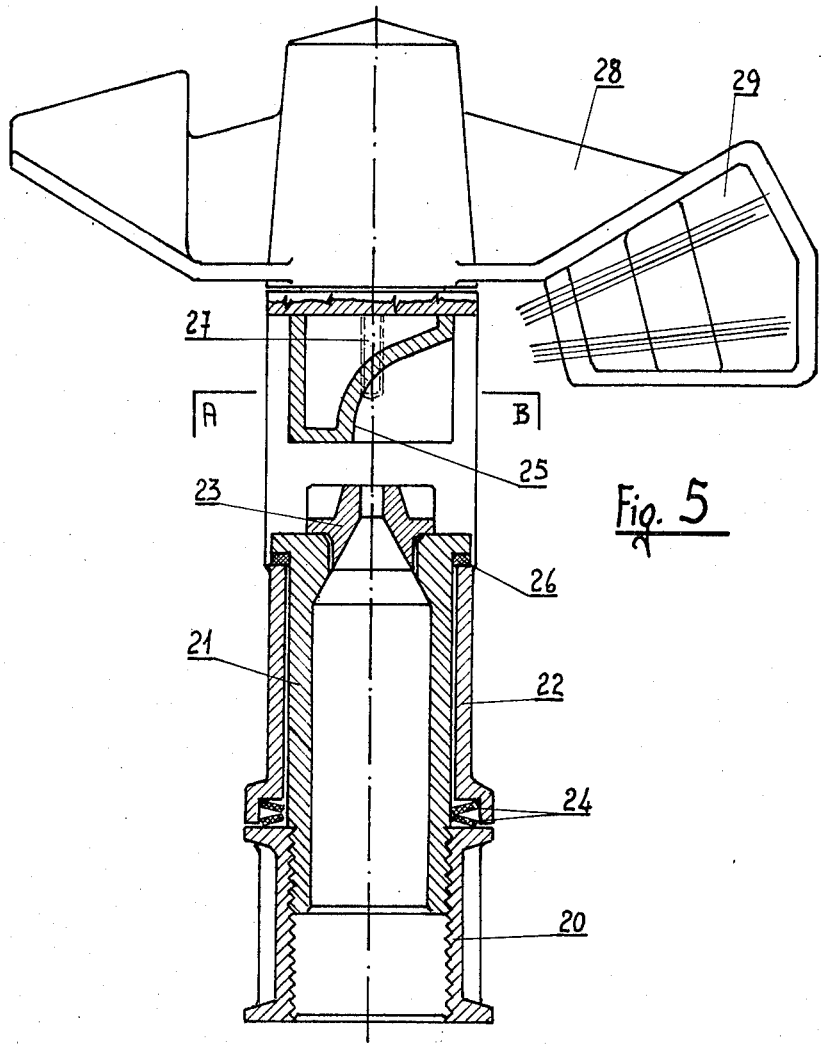
Figure 6:
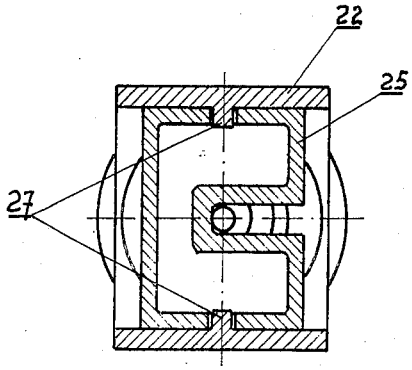

The invention will be further described, by way of example, with reference to the accompanying drawings, in which:

FIG. 1 is a part-section through a first embodiment of a sprinkler in accordance with the present invention, FIG. 2 is a side view of a detail of a baffle forming part of the sprinkler shown in FIG. 1, FIG. 3 is a section through an embodiment of a baffle for providing two jets, FIG. 4 is a section through a baffle suitable for providing a jet for watering under foliage, FIG. 5 is a part-section through a second embodiment of a sprinkler in accordance with the present invention, and FIG. 6 is a sectional view taken along the line A-B of FIG. 5.

The sprinkler shown in FIG. 1 comprises a sleeve 1 suitably threaded at one end to be screw-connected to a water feed pipe (not shown). The upper end of the sleeve 1 is suitably shaped so as to receive an interchangeable nozzle 3. The sleeve 1 is surrounded, along part of its length, by the lower portion of a movable member 2 which is coaxially mounted with the sleeve so as to be capable of rotating with respect to the sleeve 1. The rotatable mounting of the member 2 on the sleeve 1 is effected by means of pin members 6, such rotation being controlled and halted by means of springs 5 located within suitable recesses formed between the sleeve 1 and the number 2. The member 2 is hollow and a baffle 4 is located within the hollow central region thereof. The baffle is suitably shaped to direct, in the desired manner, the water issuing from the nozzle 3.

The baffle 4 is fixedly mounted on the member 2 and therefore rotates therewith. The sleeve 1, member 2 and baffle 4 are coaxial with one another. A swing arm 8 is rotatably mounted on the upper part of member 2. Swing arm 8 is rotatably mounted by means of further pin members 6 so that it can rotate about the common axis of the sleeve 1 and rotatable member 2. The arm, on one of its faces, carries a shaped portion 9 which lies in the path of the water issuing from the nozzle 3 and directed by the baffle 4. The arm 8, and its associated portion 9, are retained in a rest position by a return spring 10. The portion 9 is so shaped that, when in its rest position, it projects into the path of the jet of water irrespective of the shape of the baffle employed. It will be appreciated that when the water strikes against the shaped portion 9, this latter will be deflected. In due course, the force of the return spring will overcome the water pressure and will return the arm to its rest position. Such angular displacements will be transmitted to the rotatable member 2, the amount of such displacement being determined by the force of the return spring 10. The limit of such displacement of the member 2 is limited by the cup spring 5.

As previously mentioned, sprays having different characteristics can be achieved by simply interchanging the baffles. Thus, the baffle shown in FIG. 1 provides a single jet having a high angle of elevation, the baffle shown in FIG. 3 provides two jets each having a high angle of elevation and FIG. 4 shows a baffle providing a single jet having a lower angle of elevation.

The springs 5, besides acting as a limit for rotation of the member 2, acts as seals to prevent foreign matter penetrating from externally into the interior of the sprinkler. Above the nozzle 3, a further seal 7 is provided for preventing the ingress of foreign matter. However, this seal 7 is static and does not corrode.

The assembling of the sprinkler shown in FIGS. 1 to 4 will now be described. Firstly, the desired nozzle 3 is fitted onto the sleeve 1. The desired baffle 4 and seal 7 are then inserted onto the member 2. The springs 5 are located externally of the sleeve 1 but internally of the member 2. These springs axially retain the sleeve 1 in the member 2 when the sleeve is inserted into the member 2. The pins 6 form a roller bearing for the member 2 with respect to the sleeve 1. The arm 8 and its shaped member 9 are then assembled with the spring 10 and fitted onto the pins 6 so as to be pivotally mounted on the upper portion of the member 2.

In FIG. 2, the baffle is seen from the side from which the jet of water issues. It will be seen that the water channel is wider in the lower region 12 of the baffle, that is to say, in the region nearer the nozzle 3, than it is in the upper region 13. This permits the same baffle to be used with a variety of nozzles to provide jets having different characteristics.

The baffle shown in FIG. 3 divided the water stream 14 into two jets 15 and 16. The portion 17 of the baffle divided the stream into two jets. If this portion 17 is centrally located, the stream will be divided into two substantially identical jets. However, by laterally displacing the portion 17, it will be readily apparent that the two jets produced will have different characteristics. In FIG. 4, the water stream 18 is converted into a long, low elevation jet 19.

The sprinkler shown in FIGS. 1 to 4 is extremely suitable for use on those occasions when it is rarely desired to change the characteristics of the jet, that is to say, when the nozzle 3 and/or baffle 4 are not to be frequently changed. To change the baffle or nozzle, it is necessary to dissasemble the rotatable member 2 or to unscrew the sprinkler from the feed pipe.

The embodiment of the sprinkler shown in FIGS. 5 and 6 is more suitable for use on those occasions when the baffle and/or nozzle require regular interchanging. In this embodiment, the sleeve 20 is provided with a fitting 21 screwed thereonto. The rotatable member 22 is prevented from axial movement by the fitting 21 and its rotation is limited by cup springs 24. Sealing of the interior of the spinkler to prevent the ingress of foreign matter is effected by the springs 24 and a seal 26.

The baffle 25 is housed in the upper portion of the member 22 which is bifurcated, as best seen in FIG. 6. Swing arm 28 having so-called shovel shaped member 29 are assembled on the upper portion of the member 22. The shovel shaped member 29 is so shaped as to lie in the path of jets having differing angles of elevation.

The baffle 25 is retained in position in the forked portion of member 22 by means of two ribs 27. This can best be seen in FIG. 6. The nozzle 23 can be interchanged simply by unscrewing the fitting 21. When the nozzle has been removed, the baffle can also be removed by pulling it downwardly, thereby disengaging it from the ribs 27, and removing it sideways from the fork. The baffle can also be housed in the member 22 so as to influence the characteristics of the issuing jet of water.

I claim:

1. A water sprinkler comprising a sleeve portion fixedly mountable on a water supply pipe, a rotatable member rotatably mounted on the sleeve, nozzle means fixedly mounted in the upper portion of the sleeve so as to be coaxial therewith, and a baffle located within the rotatable member, the baffle being coaxial with the sleeve, the rotatable member having pivotally mounted thereon at least one swing arm carrying at least one shaped member adapted, in use, to lie in the path of water issued from the nozzle and deflected by the baffle.

2. A sprinkler as claimed in claim 1 wherein the rotational movement of the body member, caused by the pivotal movement of the swing arm and its associated shaped member, with respect to the sleeve member is controlled by a return spring acting on the swing arm member and is limited by cup springs located between the sleeve and the rotatable member, the cup springs simultaneously acting as a seal to prevent ingress of foreign matter into the interior of the sprinkler.

3. A sprinkler as claimed in claim 1 wherein the baffle is shaped so as, in use, to produce a single jet of water.

4. A sprinkler as claimed in claim 1 wherein the baffle is shaped so as, in use, to produce a plurality of jets of water simultaneously.

5. A sprinkler as claimed in claim 4 wherein the baffle is asymmetic so as, in use, to provide a plurality of jets of water having differing characteristics.

6. A sprinkler as claimed in claim 1, wherein the baffle defines an inlet and an outlet channel for the water, the inlet channel having a larger cross-sectional area than the inlet channel.

7. A sprinkler as claimed in claim 1, wherein the rotatable member is provided with ribs which engage in recesses formed in the baffle whereby the rotatable member and the baffle are fixedly interconnected.

8. A sprinkler as claimed in claim 1 wherein the sleeve portion is a unitary structure.

9. A sprinkler as claimed in claim 1, wherein the sleeve portion is formed of two fixedly interconnectable members, the baffle being fixedly connected to one of the members and the other member having means for fixedly mounting a water supply pipe thereon.

* * * * *